US008656998B2

(12) United States Patent
Dong et al.

(10) Patent No.: US 8,656,998 B2
(45) Date of Patent: Feb. 25, 2014

(54) IN SITU HEATING FOR RESERVOIR CHAMBER DEVELOPMENT

(75) Inventors: Shuxing Dong, Beijing (CN); Thomas J. Wheeler, Houston, TX (US); W. Reid Dreher, Jr., College Station, TX (US)

(73) Assignee: ConocoPhillips Company, Houston, TX (US)

( * ) Notice: Subject to any disclaimer, the term of this patent is extended or adjusted under 35 U.S.C. 154(b) by 540 days.

(21) Appl. No.: 12/949,581

(22) Filed: Nov. 18, 2010

(65) Prior Publication Data

US 2011/0120710 A1 May 26, 2011

Related U.S. Application Data

(60) Provisional application No. 61/263,547, filed on Nov. 23, 2009.

(51) Int. Cl.
*E21B 43/24* (2006.01)
*E21B 36/00* (2006.01)

(52) U.S. Cl.
USPC ..... 166/272.3; 166/303; 166/60; 166/302

(58) Field of Classification Search
USPC ..... 166/303, 272.1–272.7, 57, 60, 248, 302
See application file for complete search history.

(56) References Cited

U.S. PATENT DOCUMENTS

| | | | | |
|---|---|---|---|---|
| 4,140,180 | A | 2/1979 | Bridges et al. | |
| 5,046,559 | A * | 9/1991 | Glandt | 166/248 |
| 5,060,726 | A * | 10/1991 | Glandt et al. | 166/248 |
| 6,631,761 | B2 | 10/2003 | Yuan et al. | |
| 6,662,872 | B2 * | 12/2003 | Gutek et al. | 166/272.4 |
| 7,051,808 | B1 | 5/2006 | Vinegar et al. | |
| 7,331,385 | B2 * | 2/2008 | Symington et al. | 166/248 |
| 2007/0045267 | A1 | 3/2007 | Vinegar et al. | |
| 2008/0230219 | A1 | 9/2008 | Kaminsky | |

FOREIGN PATENT DOCUMENTS

| | | |
|---|---|---|
| GB | 896407 | 5/1960 |
| WO | WO2007084763 | 7/2007 |

OTHER PUBLICATIONS

"Electrical Conductivity," Wolfram Research, http://scienceworld.wolfram.com/physics/ElectricalConductivity.html, accessed Feb. 11, 2013.*

Kirk, Randy, "Likely Beneficiaries of Heavy Oil Production Technologies: Schlumberger, Imperial Oil," Dec. 7, 2007, Source: Schlumberger, pp. 1-7.

Britten, A. J., et al., "Heavy Petroleum Upgrading by Microwave Irradiation," WIT Transactions on Modelling and Simulation, vol. 41, 2005 WIT Press, pp. 103-112.

* cited by examiner

*Primary Examiner* — Angela M DiTrani
(74) *Attorney, Agent, or Firm* — ConocoPhillips Company

(57) ABSTRACT

Methods and apparatus relate to systems and methods of recovering oil from a formation. In operation, a steam chamber develops as a result of steam injection into the formation and the recovery of fluids including the oil through a production well. An auxiliary well spaced in a lateral direction from the production well helps ensure development of the steam chamber as desired. The auxiliary well may enable heating of the formation through establishing an electric potential between the auxiliary well and the production well or by resistive heating of material forming the auxiliary well. Further, the auxiliary well may provide a flow path for solvent or gas injection to facilitate the recovery through the production well.

17 Claims, 4 Drawing Sheets

IN SITU HEATING FOR RESERVOIR CHAMBER DEVELOPMENT

CROSS-REFERENCE TO RELATED APPLICATIONS

This application is a non-provisional application which claims benefit under 35 USC §119(e) to U.S. Provisional Application Ser. No. 61/263,547 filed Nov. 23, 2009, entitled "IN SITU HEATING FOR RESERVOIR CHAMBER DEVELOPMENT," which is incorporated herein in its entirety.

STATEMENT REGARDING FEDERALLY SPONSORED RESEARCH OR DEVELOPMENT

None

FIELD OF THE INVENTION

Embodiments of the invention relate to methods and systems for in situ electric heating with steam assisted oil recovery.

BACKGROUND OF THE INVENTION

In order to recover oils from certain geologic formations, steam can be injected to increase the mobility of the oil within the formation via such processes known as steam assisted gravity drainage (SAGD). The oil that is made mobile enough to flow through the formation due to gravity gathers in a well for production. Cost of prior approaches to drain reservoirs containing the oil with a natural viscosity that inhibits the recovery makes any inefficiency a problem. Various factors may prevent achieving performance levels as high as desired or needed for economic success.

One example of the factors influencing the economic success of the SAGD includes duration of startup time while steam is circulated without production to establish fluid communication between an injector and producer well pair. In addition, heterogeneities in the formation can prevent full development of chambers formed in the formation by the steam if migration of the steam is blocked. The chambers also tend to develop upward with less lateral development since gravity influences required for momentum decreases as the chambers spread. As a result, percentage of the oil recoverable from areas located between two adjacent steam chambers and toward bottoms of the chambers diminishes relative to where the chambers form and may merge together in the formation. Speed of the lateral development for the chambers further influences rate at which the oil can be produced.

Therefore, a need exists for improved methods and systems for developing chambers in reservoirs formed during steam assisted oil recovery.

SUMMARY OF THE INVENTION

In one embodiment, a method of obtaining recovery from a reservoir includes supplying electric current to an auxiliary well offset in a lateral direction from a well pair arranged for steam assisted gravity drainage of oil in a formation. The method further includes injecting steam into the formation through an injector of the well pair and producing through a producer of the well pair both oil heated by the steam and water condensate to develop within the formation a steam chamber. Heating of the oil as a result of the electric current being supplied to the auxiliary well facilitates lateral development of the steam chamber.

According to one embodiment, a method of obtaining recovery from a reservoir includes passing electric current through a formation between a production well and an auxiliary well offset in a lateral direction from the production well. Further, injecting steam into the formation and producing through a production well water condensate and oil that is from the formation and is heated by the steam develops within the formation a steam chamber that the production well is disposed beneath. The passing of the electric current occurs during the injecting and the producing in order to heat the oil for promoting lateral development of the steam chamber.

For one embodiment, a method of obtaining recovery from a reservoir includes creating an electric potential between a well pair and an auxiliary well offset in a lateral direction from the well pair and circulating steam through an injector of the well pair and through a producer of the well pair while creating the electric potential. The circulating of the steam and the electric potential heats oil in an area of formation between the injector and the producer in order to initiate fluid communication between the injector and the producer. After the fluid communication is established, injecting steam into the formation through the injector and producing through the producer water condensate and the oil heated by the steam develops within the formation a steam chamber, in which development in the lateral direction is facilitated by the oil being heated due to the electric potential.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to systems and methods to recover oil from a formation. In operation, a steam chamber develops as a result of steam injection into the formation and the recovery of fluids including the oil through a production well. An auxiliary well spaced in a lateral direction from the production well helps ensure development of the steam chamber as desired. The auxiliary well may enable heating of the formation through establishing an electric potential between the auxiliary well and the production well or by resistive heating of material forming the auxiliary well. Further, the auxiliary well may provide a flow path for solvent or gas injection to facilitate the recovery through the production well.

Figure 1:
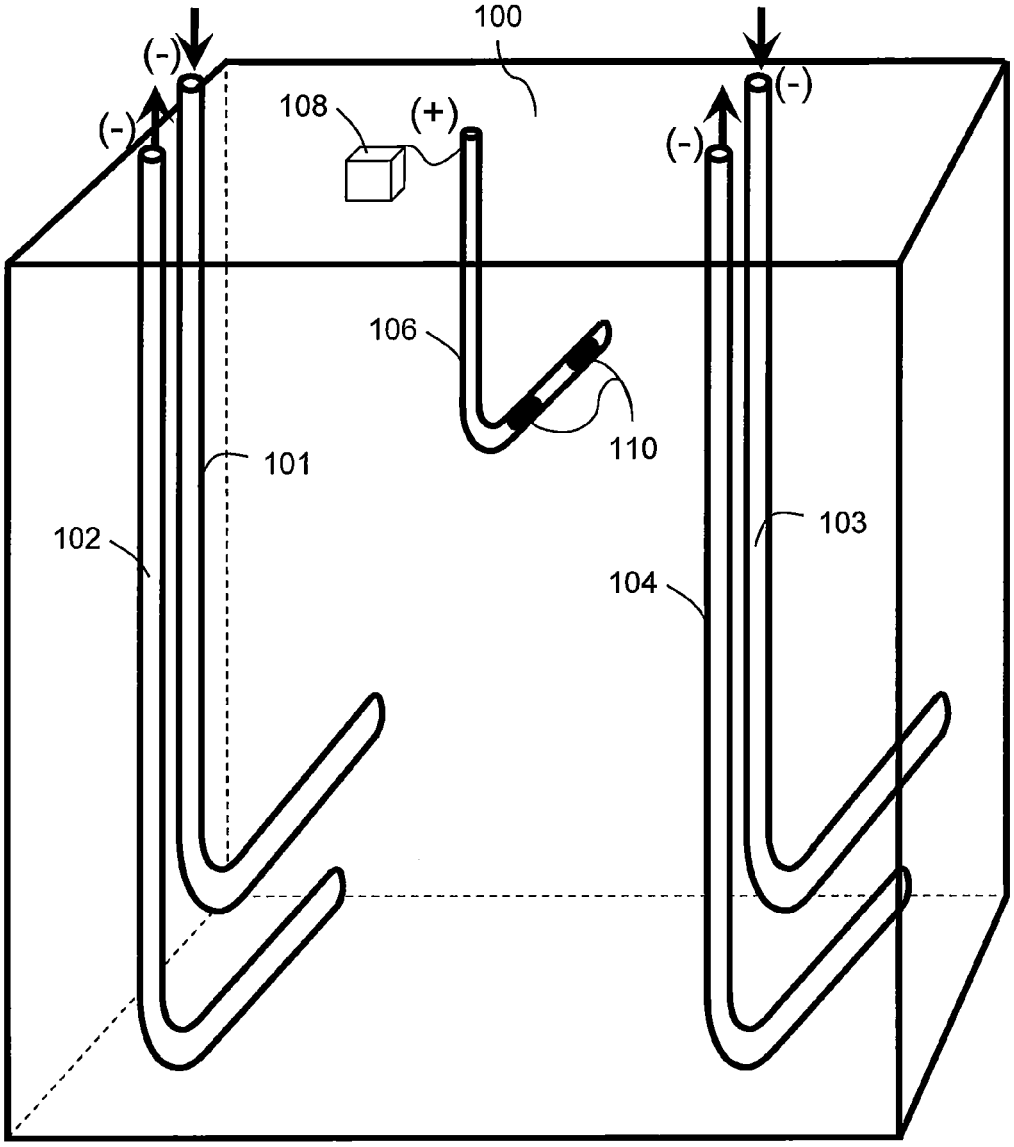
FIG. 1 is a schematic of a production system for oil recovery with steam injection including an auxiliary well operable to facilitate the recovery from a formation through a production well, according to one embodiment of the invention.

FIG. 1 illustrates a formation 100 that includes a first injector 101 arranged to pair with a first producer 102 and a second injector 103 paired with a second producer 104. Each of the injectors and producers 101-104 include horizontal borehole lengths extending through the formation 100. The first injector 101 and the first producer 102 align with one another in a lateral direction but offset in the lateral direction from the second injector 103 and the second producer 104. Steam introduced through the first and second injectors 101, 103 disposed above (e.g., about 5 meters) and parallel to a respective one of the first and second producers 102, 104 enables production of fluids including heated oil and water condensate through the producers 102, 104 by a process referred to as steam assisted gravity drainage (SAGD). In some embodiments, the first and second injectors 101, 103 introduce the steam in a mixture with solvents for the oil such as carbon dioxide, pentane or pentane and higher hydrocarbon mixtures.

An auxiliary well 106 extends through the formation at a location offset (e.g., at least 5 meters) in the lateral direction from the first injector 101 and the first producer 102. The auxiliary well 106 may include a horizontal borehole length that is disposed higher in the formation relative to the horizontal borehole lengths of the first injector 101 and the first producer 102. Position of the auxiliary well 106 relative to the injectors 101, 103 and the producers 102, 104 thus locates the auxiliary well 106 between and parallel to well pairs used for the SAGD.

For some embodiments, the auxiliary well 106 couples to a power source 108 that supplies direct or alternating current to one or more electrodes 110 that may be spaced from one another along the length of the auxiliary well 106. Completion of the auxiliary well 106 other than at the electrodes 110 may include non-conductive tubing, which conveys and separates the electrodes 110 downhole. In operation, the power source 108 applies a voltage between the electrodes 110 used as anodes and conductive tubing such as steel casing of both the injectors 101, 103 and the producers 102, 104 forming cathodes.

Figure 2:
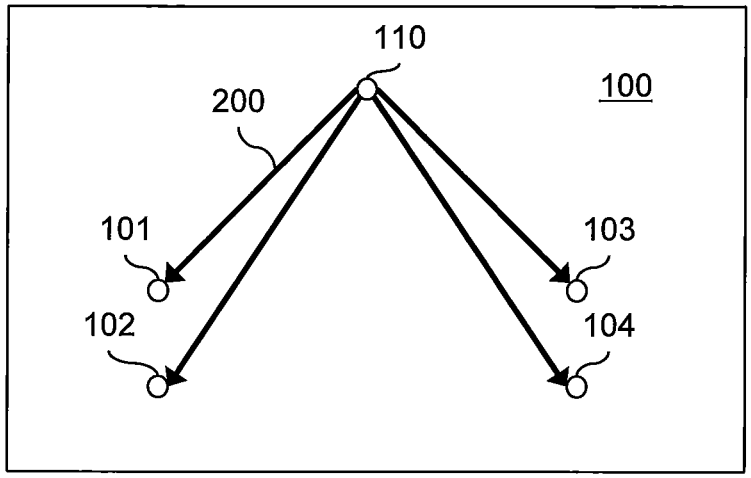
FIG. 2 is a schematic of the production system shown in FIG. 1 along a plane extending into the formation with general electric current paths between horizontal boreholes depicted by arrows, according to one embodiment of the invention.

FIG. 2 illustrates general paths of electric current 200 depicted by arrows from the electrodes 110 of the auxiliary well 106 to the injectors 101, 103 and the producers 102, 104. The electric current 200 passing through the formation 100 causes resistive heating of conductive fluids in the formation 100. The resistive heating from the electric current 200 reduces viscosity of the oil.

Current density in the formation 100 increases around the injectors 101, 103 and the producers 102, 104 as the electric current 200 passes toward and concentrates at the injectors 101, 103 and the producers 102, 104. This relative higher current density around the injectors 101, 103 and the producers 102, 104 may facilitate heating of the oil and establishing fluid communication between the first injector 101 and the first producer 102 and between the second injector 103 and the second producer 104 as required to bring production online. Startup with steam circulation alone through each of the injectors 101, 103 and the producers 102, 104 can take several months to establish the fluid communication. Given cost of steam generation and such expensive production delay, supplementing heating resulting from the circulation of the steam concurrent with the resistive heating due to the electric current 200 generated using the electrodes 110 can shorten a time period for the startup.

Figure 3:
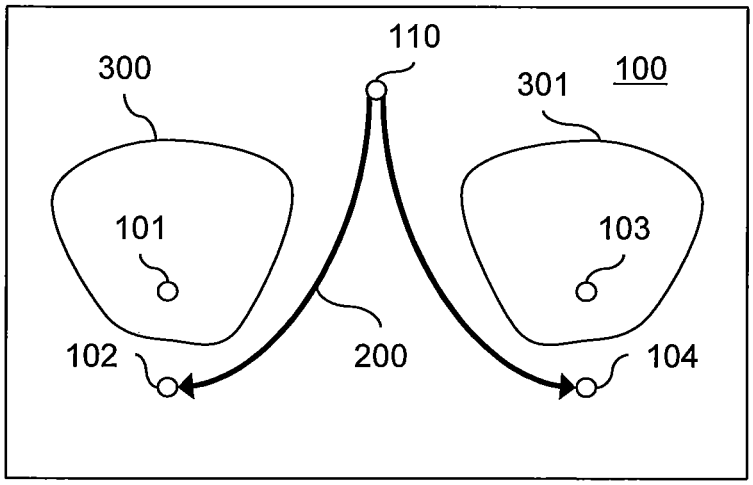
FIG. 3 is a schematic of the electric current paths as shown in FIG. 2 after steam chambers begin developing, according to one embodiment of the invention.

FIG. 3 shows the electric current 200 after first and second steam chambers 300, 301 begin developing respectively above the first and second injectors 101, 103 through which steam is introduced into the formation 100. The steam chambers 300, 301 contain vapor that does not provide a conductor for the electric current 200, which thereby bypasses the injector wells 101, 103. The electric current 200 thus provides the resistive heating to an area of the formation 100 between the steam chambers 300, 301 and does not heat the steam chambers 300, 301 where the oil has already been drained and further heating can waste energy. The resistive heating caused by the electric current 200 promotes lateral evolvement of the steam chambers 300, 301 and reduces viscosity of the oil within an intermediate area where recovery of the oil based on injection of the steam is limited.

Figure 4:
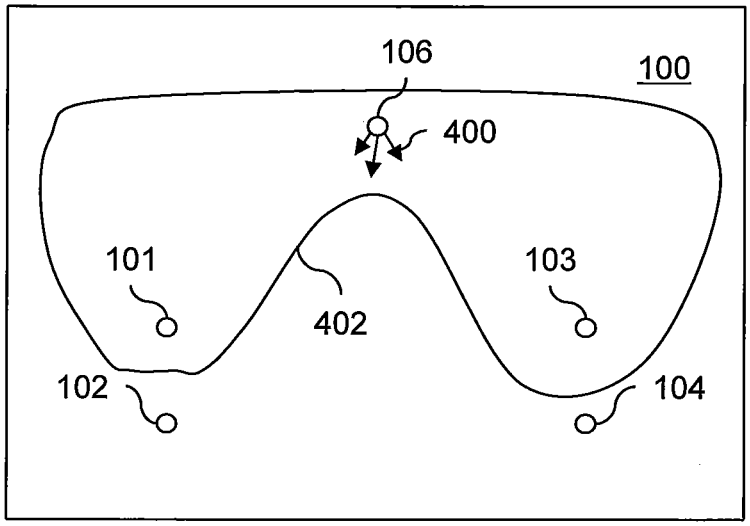
FIG. 4 is a schematic showing injection of fluid via the auxiliary well to further facilitate developing the steam chambers, according to one embodiment of the invention.

FIG. 4 illustrates injection of fluid 400 into the formation 100 via the auxiliary well 106 to facilitate developing a merged steam chamber 402. Examples of the fluid 400 include solvents for the oil such as pentane and mixtures of pentane-plus (C5+) hydrocarbons. In some embodiments, nitrogen and/or carbon dioxide provide the fluid 400, which may be flue gas exhaust. Such gas drive may occur during the heating by the electric current 200 as described herein if sufficient residual water remains in the formation 100 to maintain conductivity. The injection of the fluid 400 between the well pairs used for the SAGD can promote forming the merged steam chamber 402 prior to lateral amalgamation. The fluid 400 based on location of the injection also helps with the recovery from the intermediate area that is below the auxiliary well 106. In some embodiments, the auxiliary well 106 is first utilized to generate the potential, is then employed for injection of the solvent, and thereafter once encompassed by the merged steam chamber 402 is used for gas injection.

Figure 5:
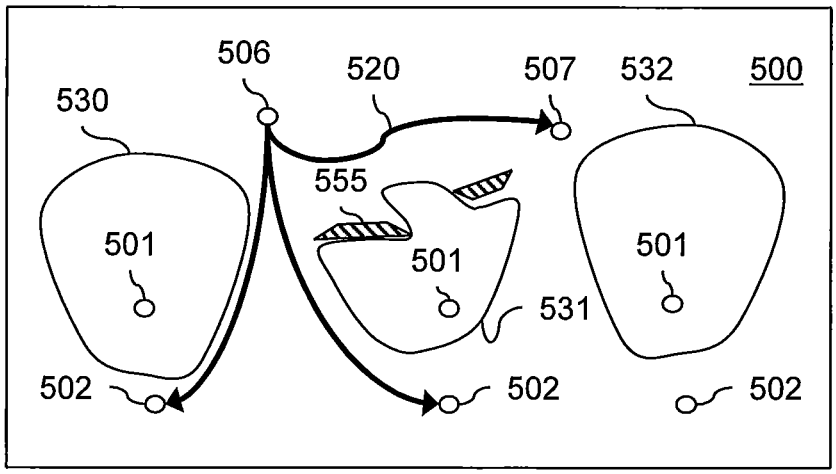
FIG. 5 is a schematic illustrating an exemplary configuration employed to tailor resistive heating from electric current to achieve steam chamber development, according to one embodiment of the invention.

FIG. 5 shows a formation 500 having an exemplary configuration of steam injection wells 501, production wells 502, an auxiliary first well 506 and an auxiliary second well 507. Positions in the formation 500 provide a respective one of the first and second wells 506, 507 interleaved between each pair of the injection and production wells 501, 502. First, second and third SAGD chambers 530, 531, 532 form during operation. Heterogeneities such as impermeable layer 555 of the formation 500 inhibit development of the second SAGD chamber 531. Selective conversion of the auxiliary second well 507 to function as a cathode while the auxiliary first well 506 is an anode produces a voltage across the auxiliary first and second wells 506, 507. Current 520 passes through the formation from the auxiliary first well 506 toward the auxiliary second well 507 and any of the production wells 502 in proximity to establish an electric potential. The resistive heating by the current 520 passing between the auxiliary first and second wells 506, 507 reduces viscosity of the oil in order to enable or accelerate recovery of the oil in areas where the second SAGD chamber 531 lacks complete upward development.

Conductivity between the auxiliary first well 506 and each of the injection, production and auxiliary second wells 501, 502, 507 changes as the first and second SAGD chambers 530, 531 develop. Measuring the conductivity hence provides an indication of the development of the first and/or second SAGD chambers 530, 531 and/or potential merging together of the first and/or second SAGD chambers 530, 531 into one. Since electrodes utilized in the first and/or second auxiliary wells 506, 507 may be spaced out like the electrodes 110 shown in FIG. 1, the conductivity measured can identify which part of the SAGD chambers 530, 531, 532 are merged along horizontal lengths of the wells 501, 502, 506, 507 based on differences in the conductivity at each electrode.

Adjusting operation parameters based on information gained from measurements of the conductivity provides ability to manipulate development of the chambers 530, 531, 532 so that as much of the oil is recovered from the formation as economical as possible. For example, the conversion of the auxiliary second well 507 from anode to cathode may be decided in view of the measurements being indicative of inhibited upward development of the second SAGD chamber 531. In some embodiments, the measurements may dictate flow rates and locations for steam introduction at different discrete lengths of each of the injection wells 501.

Figure 6:
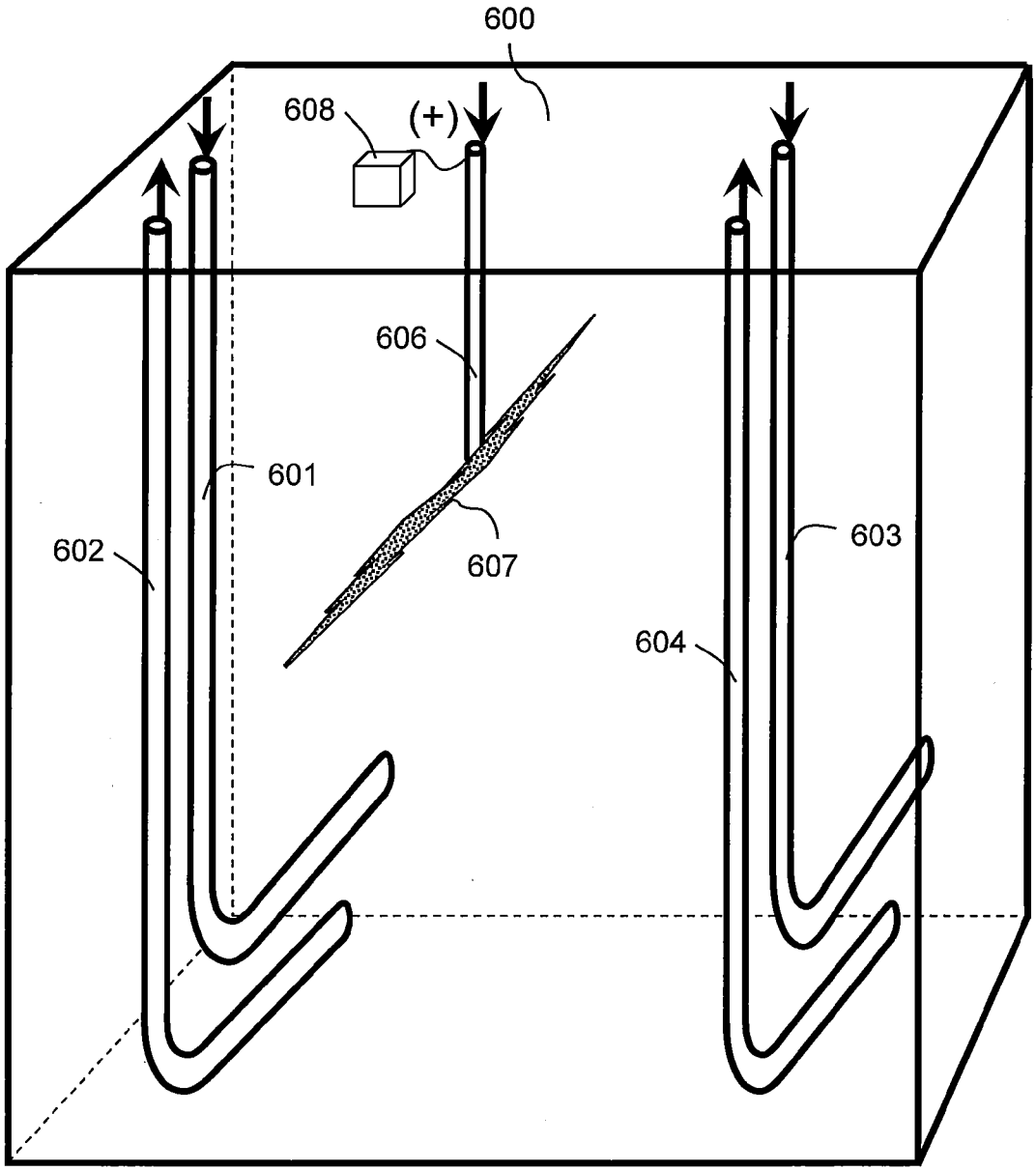
FIG. 6 is a schematic of a setup that includes a resistive heating well completed by fracturing and applying a metal proppant to make operable for facilitating oil recovery with steam injection, according to one embodiment of the invention.

FIG. 6 illustrates a formation 600 into which first and second upper wells 601, 603 and first and second lower wells 602, 604 are drilled for steam assisted oil recovery like described with respect to FIG. 1. The formation 600 includes a resistive heating well 606 that for some embodiments is completed by fracturing and applying a metal proppant 607 within resulting fractures. The fractures create high permeability flow paths to support development of subsequent steam chambers without added horizontal drilling costs. For some embodiments, the metal proppant 607 or other conductive particles may fill drilled boreholes instead of the fractures. Location of the resistive heating well 606 between pairs of the upper and lower wells 601, 603, 602, 604 corresponds to the auxiliary well 106 in FIG. 1.

The resistive heating well 606 may not provide an anode-cathode relation with the upper and lower wells 601, 603, 602, 604. Rather, resistive heating of material, such as the proppant 607, that forms part of the heating well 606 transfers heat from the proppant 607 to a surrounding area of the formation 600 resulting in reducing viscosity of the oil. The proppant 607 relative to conventional electrodes provide greater surface area to deploy current from a power supply 608. Current density spreads out across the surface area of the proppant 607 limiting degradation of the proppant 607 and undesired coking around the proppant 607.

For some embodiments, the resistive heating well 606 provides a flow path for injection of gas or solvent for the oil, such as described herein. The proppant 607 if used for heating may transfer heat to the gas or solvent being injected. Since the solvent or gas is thus heated in situ, employing the heating well 606 for injection of the gas or solvent avoids thermal loss from conveying fluids downhole that are preheated at surface.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method, comprising:

supplying electric current to an auxiliary well offset in a lateral direction from a well pair arranged for steam assisted gravity drainage of oil in a formation;

injecting steam into the formation through an injector of the well pair; and producing through a producer of the well pair both oil heated by the steam and water condensate to develop within the formation a steam chamber, wherein the supplying of the electric current creates an electric potential between the auxiliary well as an anode and both the injector and the producer as cathodes prior to developing the steam chamber and creates an electric potential between the auxiliary well and the producer during the injecting and the producing to facilitate lateral development of the steam chamber by the oil being heated as a result of the electric current being supplied to the auxiliary well.

2. The method according to claim 1, wherein the supplying of the electric current creates an electric potential between the auxiliary well and both the injector and the producer such that the oil in an area between the injector and the producer is heated to initiate fluid communication between the injector and the producer.

3. The method according to claim 1, further comprising circulating steam through the injector and through the producer while supplying the electric current.

4. The method according to claim 1, further comprising filling part of the auxiliary well with conductive particles, wherein the supplying of the electric current causes resistive heating of the particles.

5. The method according to claim 1, further comprising fracturing the formation to cause fractures that are filled with conductive proppant, wherein the supplying of the electric current causes resistive heating of the proppant.

6. The method according to claim 1, wherein the auxiliary well includes a horizontal borehole length disposed higher in the formation relative to horizontal wellbore extensions of the injector and producer.

7. The method according to claim 1, further comprising injecting at least one of a gas and a solvent for the oil into the auxiliary well.

8. The method according to claim 1, further comprising injecting a fluid into the auxiliary well, wherein heat is transferred in situ to the fluid from resistive heating by the electric current of a material that forms part of the auxiliary well.

9. The method according to claim 1, further comprising detecting conductivity between the auxiliary well and at least one of the injector and the producer.

10. The method according to claim 1, further comprising controlling development of the steam chamber based on conductivity measurement between the auxiliary well and at least one of the injector and the producer.

11. The method according to claim 1, wherein the supplying of the electric current creates an electric potential between the auxiliary well and a counter electrode disposed in a wellbore offset from the well pair opposite the lateral direction in which the auxiliary well is offset.

12. The method according to claim 1, further comprising switching from the supplying of the electric current to injecting a fluid into the auxiliary well after the steam chamber encompasses electrodes of the auxiliary well.

13. The method according to claim 1, further comprising switching from the supplying of the electric current to injecting a solvent into the auxiliary well and then to injecting a gas into the auxiliary well as the steam chamber develops.

14. A method, comprising:

passing electric current through a formation between a first electrode at a production well and a second electrode at an auxiliary well offset in a lateral direction from the production well;

injecting steam into the formation; and producing through the production well water condensate and oil that is from the formation and is heated by the steam, wherein the injecting and producing develop within the formation a steam chamber that the production well is disposed beneath and the passing of the electric current occurs during the injecting and the producing in order to heat the oil for promoting lateral development of the steam chamber.

15. The method according to claim 14, wherein the auxiliary well is disposed between a first injector-producer well pair and a second injector-producer well pair that includes the production well.

16. A method, comprising:

creating an electric potential between a well pair and an auxiliary well offset in a lateral direction from the well pair as a result of the well pair and the auxiliary well forming a cathode and an anode;

circulating steam through an injector of the well pair and through a producer of the well pair while creating the electric potential, wherein oil in an area of formation between the injector and the producer is heated due to the circulating of the steam and the electric potential in order to initiate fluid communication between the injector and the producer;

injecting steam into the formation through the injector; and producing through the producer water condensate and the oil heated by the steam while injecting the steam, wherein after the fluid communication is established the injecting and producing develop within the formation a steam chamber and development of the steam chamber in the lateral direction is facilitated by the oil being heated due to the electric potential, which is maintained between the auxiliary well and the producer during the injecting and the producing in order to continue heating of the oil for further promoting the development of the steam chamber in the lateral direction.

17. The method according to claim 16, wherein the injector and the producer include horizontal parallel wellbore extensions separated by height in the formation and the auxiliary well includes a horizontal borehole length disposed higher in the formation relative to of the horizontal parallel wellbore extensions of the injector and the producer.

* * * * *